United States Patent [19]

Hannah

[11] 3,959,838

[45] June 1, 1976

[54] UNDERWATER CLEANING

[76] Inventor: Harvey John Hannah, 514 Kensington Road, Wattle Park, Adelaide, South Australia, Australia, 50666

[22] Filed: Feb. 28, 1974

[21] Appl. No.: 446,722

[52] U.S. Cl. ..... 15/1.7; 15/387

[51] Int. Cl.[2] ..... E04H 3/20; A47L 9/04

[58] Field of Search ..... 15/1.7, 29, 387; 415/141; 418/268

[56] References Cited

UNITED STATES PATENTS

| | | | |
|---|---|---|---|
| 847,060 | 3/1907 | Gamache | 15/29 |
| 2,045,980 | 6/1936 | De Nagy | 15/387 X |
| 2,609,555 | 9/1952 | Anderson | 15/387 X |
| 2,683,276 | 7/1954 | Olsen | 15/387 |
| 3,008,159 | 11/1961 | Del Vecchio | 15/1.7 |
| 3,046,586 | 7/1962 | Allen et al. | 15/387 X |
| 3,229,315 | 1/1966 | Watson | 15/387 X |

FOREIGN PATENTS OR APPLICATIONS

| | | | |
|---|---|---|---|
| 1,342,495 | 9/1963 | France | 15/387 |

*Primary Examiner*—Edward L. Roberts
*Attorney, Agent, or Firm*—Oldham & Oldham Co.

[57] ABSTRACT

An underwater surface cleaning apparatus particularly suitable for swimming pools which includes brushes driven by suction of water from immediately around the apparatus through a vane type motor which is coupled to rotate the brush. The motor can include hinged vanes.

2 Claims, 4 Drawing Figures

UNDERWATER CLEANING

This invention relates to underwater surface cleaning devices particularly intended for cleaning of swimming pool surfaces.

BACKGROUND OF INVENTION

It has been known to provide a device commonly known as a "vacuum head" which can be drawn along the surface of the swimming pool, and by suction, draw water beneath a skirt such that any particles on the surface will tend to be picked up by the reduced pressure effect and then withdrawn by the water being circulated through a conventional filter system.

Such an arrangement has not been found to be fully effective in cleaning some types of grime or other films or compacted clays and it is not known that there is equipment able to economically and efficiently clean such difficult films.

There is also a problem with stirring the water so that the films or other particles that one is attempting to remove are in fact lifted into the water prior to their being reached by the cleaning apparatus and in suspension they can avoid being collected by the cleaning action.

Such cleaning particles may indeed tend to have an electrostatic attraction to the surface attempted to be cleaned so that even if these are violently dislodged they will tend to settle back against the surface and be as firmly adhering to the surface as previously and it is in relation to such problems that this particular invention is directed.

SUMMARY OF THE INVENTION

This invention relates to an underwater cleaning apparatus for swimming pools including a body adapted to be drawn across a surface to be cleaned, a brush rotatably supported with respect to the body to engage against the surface of the swimming pool, a water operable motor adapted to operate on water drawn from that surrounding the head through the motor to effect rotation of the drive shaft of the motor, the drive shaft being coupled to the brush to effect a rotary action of the brush and effect a cleaning action on the engaged surface.

It will be seen from this that the apparatus has firstly the feature that there is a brush which will act to abrasively or violently impinge against and dislodge particles or other grime or algae from the underwater surface and secondly while this material is then suspended within the water surrounding the apparatus as a whole, the water itself is being drawn from this location and at the same time is used to activate the brush in its cleaning action and then of course the water is drawn through the conventional "vacuum" hose to an appropriate filter system or of course to an exhaust.

The draw off of water from immediately around the vicinity of the violent dislodgement area ensures that particles which have been dislodged are caught up in the flow of water through an orifice desirably before there is any settlement and in this way the particles are removed before they settle and probably again adhere to the surface from which position they will be almost as difficult to lodge as previously.

It is a desirable feature that the brush be a fully rotatable brush held in engagement against a surface by the weight of the apparatus so as to ensure a good engagement and pressure of the brush against the surface.

Some difficulties have been experienced in obtaining an economical reliable motor arrangement which furthermore can be manufactured from materials which are corrosive resistant and yet will give sufficient power capacity to drive a brush of a desirable size.

One desirable approach as an answer to this problem has been to provide a rotor which includes radially extending vanes and water drawn into the motor is directed against the vanes so as to effect the rotation of the rotor.

In a further desirable arrangement the rotor has secured thereto a plurality of vanes which are arranged so as to be acted against by the water pressure around one portion of the periphery and are withdrawn around a further portion of the periphery of the rotor.

In a most desirable arrangement of this last described arrangement each of the vanes is pivotally secured to the rotor and a surrounding body is of generally circular cross-sectional shape with an axis displaced from that of the rotor and the vanes are retained so as to effectively close the area between the housing and the rotor.

DESCRIPTION OF PREFERRED EMBODIMENT

Figure 1:
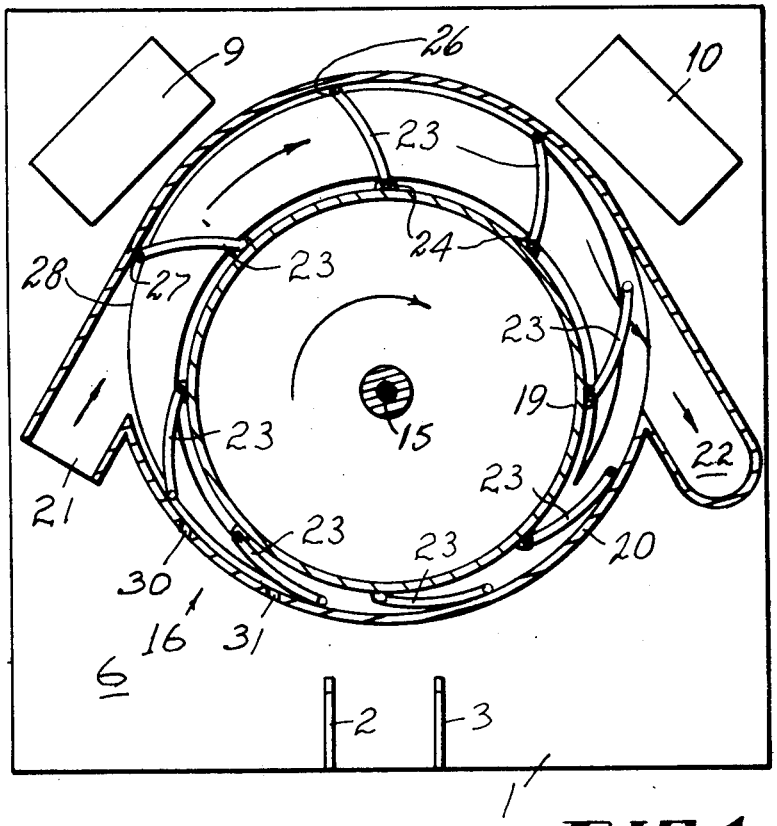
Figure 2:
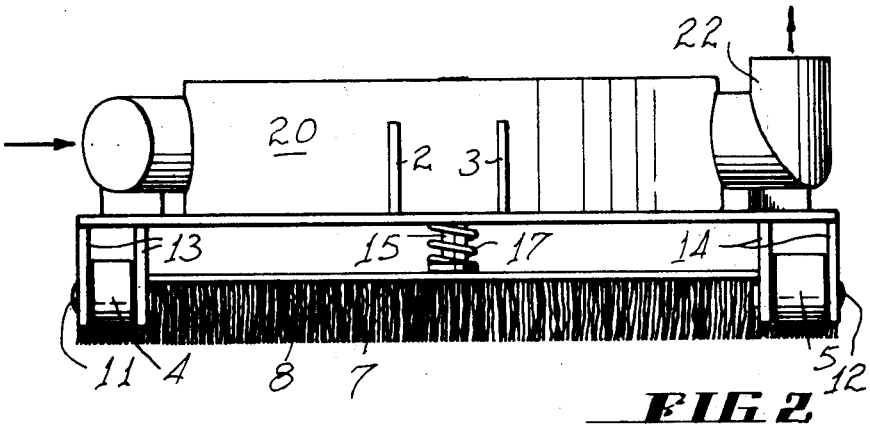
Figure 3:
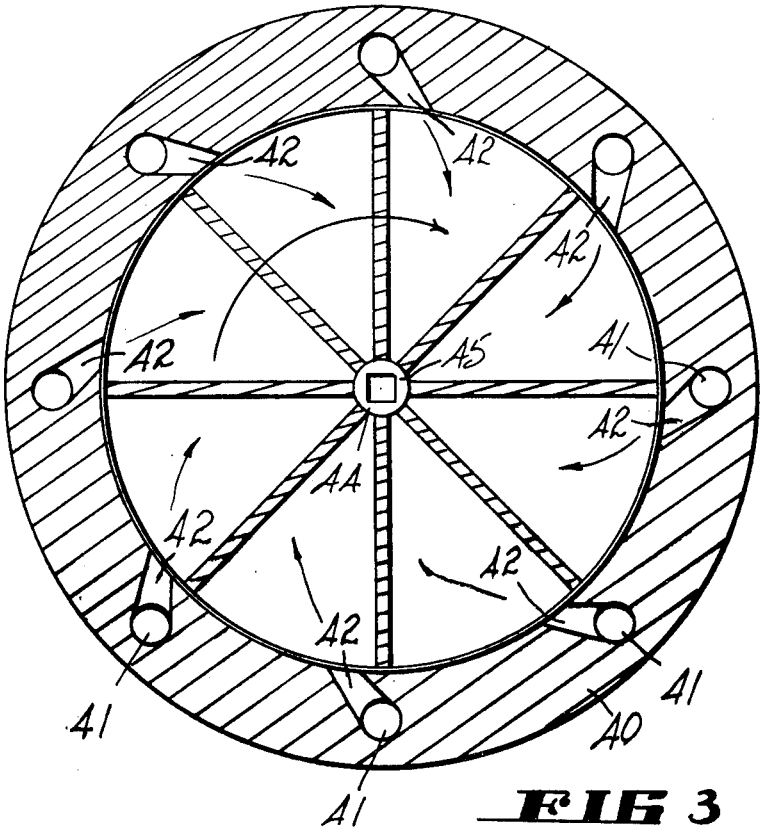
Figure 4:
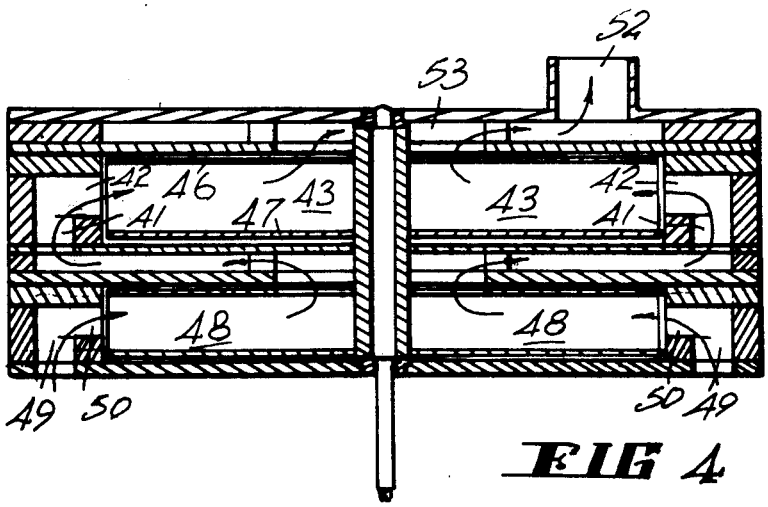

The invention will now be described and of course will be better understood with reference to preferred embodiments which are described with the assistance of drawings in which:

FIG. 1 is a plan view of a first embodiment the motor portion being partly in cross-section to show the internal workings of the vanes, FIG. 2 is a side elevation of the embodiment as in FIG. 1, FIG. 3 is a cross-sectional plan of a motor alone of a second embodiment, and FIG. 4 is a cross-section through the motor of the second embodiment as shown in FIG. 3.

Referring in detail to the drawings and in particular to the first embodiment as shown in FIGS. 1 and 2 this includes a body 1 which is adapted to be moved across the surface of a swimming pool beneath the water by means of attachment thereto of a long arm which would be pivotally secured between flanges 2 and 3 and by means of supporting wheels 4 and 5 being shown and there being two more at the further two corners of the platform 6 which are not shown.

The apparatus has depending therebelow a brush 7 which in a free state has its bristles 8 depending just below the supporting wheels such as is shown in 4 and 5 so that when the apparatus rests upon the surface of a swimming pool underneath the water there is the pressure of the body applied to the bristles to provide some force to these. This is assisted by means of lead weights 9 and 10 and can be adjusted by reason that axles 11 and 12 supporting wheels 4 and 5 are adjustable in height with respect to legs 13 and 14.

The brush as shown in FIG. 2 is circular in plan and is adapted to be rotatably driven through shaft 15 by the motor 16.

The connection between the brush 7 and the shaft 15 is flexible and this is assisted by spring 17 so that particularly where a swimming pool may have radiused edges the brush 7 will at least to some extent tend to accommodate such small variations in plane and effect a cleaning action.

The motor 16 includes a rotor 19 and a housing 20 the housing being generally of circular cross-sectional shape except for an inlet aperture 21 and an outlet aperture 22. The axial centres of the rotor 19 and the housing 20 are displaced so that upon rotation of the rotor vanes 23 each having one end 24 pivotally secured to the rotor 19, spray outwardly and then contract inwardly.

This is seen in the drawing in particular in FIG. 1 and it will be seen that the position of the vanes is also controlled by reason that the outer end 26 of each vane 23 includes an upper and lower pin 27 which tracks along track 28 so holding the vanes generally in their extended position or allowing them to retract as the case may be.

It will be observed that the inlet 21 will draw in water from the area immediately around the apparatus as a whole and partially because of the circular body form of the housing of the motor this will pick up the water and suspended particles from a substantial area in the vicinity.

The outlet 22 is connected to a conventional flexible hose which is connected to an appropriate pump and it is expected that this would then be directed into a filter and the water then returned to the swimming pool having been appropriately filtered.

It will be seen that the action of the motor as described in accordance with this first embodiment is such that the water positively engages against the vanes and as these would be in effective sealing engagement against an upper surface and a lower surface as well as the outer peripheral surface of the housing 20 there would be a result torque effecting a substantial resultant force to drive and rotate shaft 15 which would result in the substantial rotational drive of the brush 7.

Additional inlet apertures 30 and 31 can be introduced into the side wall of the housing 20 to allow for entry of water into the expanding volume behind each progressively extending vane and likewise the compressing areas preceding this can be similarly vented or coupled to the output as desired. The location of the inlet and outlet apertures is to take advantage of the most useful area of inlet and outlet drive but these obviously can be extended.

The second embodiment as shown in FIGS. 3 and 4 relies upon direct impingement of the water against vanes and to obtain a smaller size device which does not rely upon a number of moving parts and therefore is less likely to become unreliable, this second embodiment incorporates a motor which has a body 40 with a plurality of apertures 41 with outlets 42 through which water is directed to impinge perpendicularly against vanes 43. The rotor 44 includes a plurality of these vanes 43 each radially extending from a centre box 45 and these being integrally moulded with an upper cover 46 and a lower cover 47 which helps to funnel the water, the cover 46 being noncontinuous toward the boss 45 so as to leave an aperture through which the water can exit.

To develop substantial torque to drive the brush it is desirable that this be a two stage system and this is shown clearly in FIG. 4 in which there are the vanes 43 as is shown in FIG. 3 but additionally the lower vanes 48 which are in effect identical to those at 43 and as well there are the inlet apertures 49 and the directioning apertures 50.

It will be seen that there are a series of these apertures 49 which are located peripherally around the lower surface of the motor and these are open so as to pick up water in the vicinity of the brush to carry away most of the particles broken away by the brush.

The draw off outlet is shown at 52 which draws water through cavity 53 as is shown by the direction arrows in the FIG. 4.

It will be seen that the effective torque achieved by this particular embodiment is achieved by impingement of the water as it expells from the apertures 42 and 50. By this arrangement an effective torque can be achieved by a sucking of water rather than perhaps that method which might otherwise be expected to be necessary, namely a pressure supply of water, and there is the particular advantage that there is the draw off of particles which otherwise would be suspended and returned to an adhering position against the surface of the swimming pool.

I claim:

1. An underwater surface cleaning apparatus for swimming pools including a body adapted to be drawn across a surface to be cleaned, a brush rotatably supported with respect to the body so as to engage against a surface of the swimming pool, a water operable motor adapted to operate by reason of water drawn from that surrounding the apparatus and sucked through the motor whereby to effect rotation of the drive shaft of the motor, the drive shaft being coupled to the brush to effect the rotation of the brush and effect a cleaning action on the engaged underwater surface, the motor including a rotor and a housing, the rotor being within the housing and having vanes acting therebetween and following the rotor, an inlet port and an outlet port being formed in the housing and the vanes being caused by engagement with the housing to adapt a sealing engagement between the rotor and the housing and also being caused by engagement with a guiding track within the housing to take an extended position when moving between the inlet port and the said outlet port, and being caused to take a collapsed position when moving from a position adjacent said outlet port to adjacent said inlet port.

2. An underwater surface cleaning apparatus as in claim 1, where the radially inner ends of said vanes are pivotally secured to said rotor, and pin means on the radially outer ends of said vanes slidably engage said guiding track that is on said housing.

* * * * *